US011530793B2

(12) United States Patent
Reisinger et al.

(10) Patent No.: US 11,530,793 B2
(45) Date of Patent: Dec. 20, 2022

(54) LIGHTING DEVICE FOR A MOTOR VEHICLE HEADLIGHT, AND MOTOR VEHICLE HEADLIGHT

(71) Applicant: ZKW Group GmbH, Wieselburg (AT)

(72) Inventors: Bettina Reisinger, Amstetten (AT); Nina Brauner, Altlengbach (AT); Marina Fischer, Wieselburg (AT); Matthäus Artmann, Ybbs an der Donau (AT); Lukas Taudt, Wieselburg (AT); Stefan Miedler, Unterradlberg (AT); Thomas Reiter, Ferschnitz (AT)

(73) Assignee: ZKW Group GmbH, Wieselburg (AT)

( * ) Notice: Subject to any disclaimer, the term of this patent is extended or adjusted under 35 U.S.C. 154(b) by 0 days.

(21) Appl. No.: 17/414,059

(22) PCT Filed: Dec. 16, 2019

(86) PCT No.: PCT/EP2019/085400
§ 371 (c)(1),
(2) Date: Jun. 15, 2021

(87) PCT Pub. No.: WO2020/127083
PCT Pub. Date: Jun. 25, 2020

(65) Prior Publication Data

US 2022/0057065 A1 Feb. 24, 2022

(30) Foreign Application Priority Data

Dec. 18, 2018 (EP) ..... 18213493

(51) Int. Cl.
*F21S 41/663* (2018.01)
*F21S 41/25* (2018.01)
(Continued)

(52) U.S. Cl.
CPC ..... *F21S 41/663* (2018.01); *F21S 41/143* (2018.01); *F21S 41/153* (2018.01); *F21S 41/25* (2018.01)

(58) Field of Classification Search
None
See application file for complete search history.

(56) References Cited

U.S. PATENT DOCUMENTS

2008/0239746 A1 10/2008 Wuller et al.
2013/0169154 A1 4/2013 William et al.
(Continued)

FOREIGN PATENT DOCUMENTS

CN 107420825 A 1/2017
DE 102013113148 A1 5/2015
(Continued)

OTHER PUBLICATIONS

International Search Report for PCT/EP2019/085400, dated Mar. 16, 2020 (15 pages).
(Continued)

*Primary Examiner* — Elmito Breval
(74) *Attorney, Agent, or Firm* — Eversheds Sutherland (US) LLP

(57) ABSTRACT

The invention relates to a lighting device (1) for a motor vehicle headlight for generating a light pattern (LV), particularly an adaptive light pattern, e.g. an adaptive dipped headlight and main beam light pattern, or a part of a light pattern of this kind, wherein the lighting device comprises a number N of preferably identical projection modules (10, 20), where N=2, 3, 4 or greater than 4, each of the projection modules (10, 20) being designed to generate a segment light pattern (LV10, LV20). The projection modules (10, 20) are arranged with respect to one another in such a manner than, proceeding from a first projection module (10), known as the
(Continued)

Figure 1:
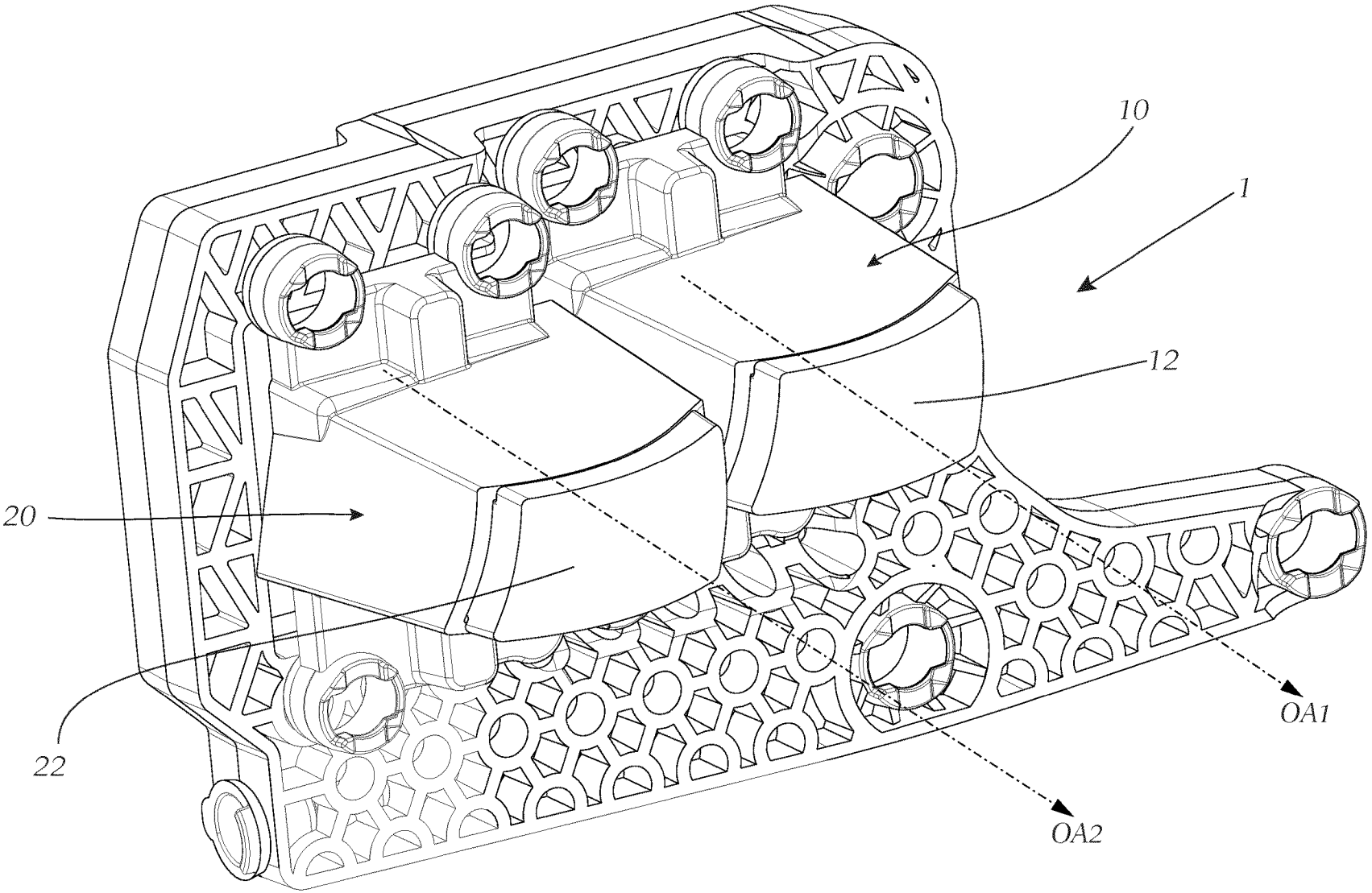

starting projection module (10), which generates what is called the starting segment light pattern (LV10), the segment light patterns (LV20; LV20, LV30) of the further projection modules (20) are displaced laterally in a, particularly in a common, horizontal direction, with the extent of the displacement. VSh, of the nth segment light pattern (LV20; LV20, LV30) of the nth projection module (20) in said horizontal direction being proportional to (n−1)/N times the principal segment width, BR, where n=2, . . . , N, and with at least one of the nth segment light patterns (LV20; LV10, LV20, LV30), n=2, . . . , N, being displaced upwards or downwards vertically in respect of the starting segment light pattern (LV10).

18 Claims, 7 Drawing Sheets

(51) Int. Cl.
*F21S 41/143* (2018.01)
*F21S 41/153* (2018.01)

(56) References Cited

U.S. PATENT DOCUMENTS

| | | | |
|---|---|---|---|
| 2013/0010485 | A1 | 10/2013 | Marten et al. |
| 2015/0003100 | A1 | 1/2015 | Liang et al. |
| 2018/0087737 | A1 | 3/2018 | Hermitte et al. |

FOREIGN PATENT DOCUMENTS

| | | | |
|---|---|---|---|
| JP | 2017224468 | A | 12/2017 |
| KR | 20160077726 | A | 4/2016 |

OTHER PUBLICATIONS

Search Report for European Patent Application No. 18213493.2, dated Jun. 25, 2019 (8 pages).

LIGHTING DEVICE FOR A MOTOR VEHICLE HEADLIGHT, AND MOTOR VEHICLE HEADLIGHT

The invention relates to a lighting device for a motor vehicle headlight for generating a light pattern, in particular an adaptive light pattern, e.g. an adaptive dipped headlight and main beam light pattern, or a part of such a light pattern, wherein the lighting device comprises a number N of projection modules, with N=2, 3, 4 or greater than 4, wherein each of the projection modules is configured to generate a segment light pattern, wherein a segment light pattern of several light segments is formed, and wherein the light segments of the segment light pattern lie in two or more substantially horizontal lines and in two or more columns, wherein the light segments lie in such a way that on activation of all light segments of the segment light pattern between the lines and the columns substantially no dark or light strips are formed, and wherein each light segment of the segment light pattern can be activated or deactivated independently of the other segments of the segment light pattern, and wherein in each line several segments, the so-called main segments, have identical main segment width, BR, and wherein all the projection modules are configured identically from an optical point of view.

The invention further relates to a motor vehicle headlight with at least one such lighting device.

The term "segment light pattern" is to be understood to mean a segmented light pattern, as is known from the prior art, in which the light pattern is to be understood of several light segments, which are arranged over one another, in columns, and adjacent to one another, in lines. The individual light segments can be switched on or off independently of the other light segments of the light pattern; provision can also be made that the individual light segments are dimmable, in particular are dimmable independently of the other light segments.

If the concern here is with light segments or light patterns which can be switched on or off or dimmed, then it is to be understood for the specialist in the art that for this, as a general rule, the respective light source(s) which is or respectively are used for the generation of the respective light segment (or of the light pattern), are switched on or off or dimmed.

The higher the number of light segments in horizontal direction, therefore within the lines, the higher the resolution is in horizontal direction. The same applies for the number of light segments in vertical direction, therefore in the columns, and the resolution in vertical direction.

An "arrangement in columns" is understood to mean that light segments of a column of a segment light pattern lie directly one over another in the sense that they are not offset laterally (horizontally) to one another, and all the light segments of a column have identical width. Equally, all the light segments of a line of a segment light pattern have the same height and lie directly adjacent to one another in the sense that they are not offset with respect to one another in vertical direction.

Projection modules for the generation of segmented light patterns are known from the prior art, in which the light segments are spaced apart from one another in the lines, i.e. two light segments of a line are respectively separated from one another by a non-illuminated region.

In the present invention, on the other hand, projection modules come into use in which the light segments which are generated with the projection module lie adjacent to one another or slightly overlap one another, both within the lines, therefore also between the lines. Frequently in such projection modules narrow, dark, more rarely light, strips occur between the individual light segments, which strips form a grid-like structure in the light image of a projection module. This can be desired, but is generally undesired, thus also in the present invention. The specialist in the art knows solutions in order to prevent such a grid structure in a segmented light image.

In currently used projection modules, which generate such a segmented light pattern, which serve for example for the generation of a fully-fledged adaptive dipped headlight and/or main beam and/or motorway light, or generally an adaptive light pattern which can switch over between main beam and dipped headlight depending on the situation, if applicable can also generate a motorway light, and/or according to the situation can block out regions in front of the vehicle to prevent the dazzling of vehicles which are driving ahead or vehicles in the oncoming traffic despite the operation of the main beam, the desired performance with respect to resolution, light flux and maximum of the light pattern can meet the requirements of the customers. However, the projection modules which are used for this are comparatively large, for example the projection lenses of such projection modules have dimensions of ca. 80 mm×50 mm.

However, modern headlight designs increasingly require smaller, in particular flat projection modules with overall heights of <25 mm or frequently even <20 mm.

In addition, from the customers' side, different requirements and wishes frequently exist for the light output and with regard to the resolution of such motor vehicle headlights.

It is an object of the invention to indicate a solution as to how segmented light patterns can be generated, in particular for the generation of an adaptive light pattern, in particular by means of flat projection modules.

This problem is solved with a lighting device mentioned in the introduction in that according to the invention the projection modules are arranged with respect to one another in such a manner that, proceeding from a first projection module, the so-called starting projection module, which generates a so-called starting segment light pattern, the segment light patterns of the further projection modules are displaced laterally in a, particularly in a common, horizontal direction, with the extent of the displacement, VSh, of the nth segment light pattern of the nth projection module (20) in said horizontal direction being proportional to (n−1)/N times the main segment width, BR, where n=2, . . . , N, and with at least one of the nth segment light patterns, n=2, . . . , N being displaced upwards or downwards vertically in respect of the starting segment light pattern.

The term "optically identical" in the present context is preferably understood to mean that two modules, in particular projection modules, which are "optically identical", with arrangement at identical position and with identical alignment, form identical light patterns, wherein in particular also the individual light segments of the projection modules are configured identically, lie at identical location in the light pattern and have the same light values (light pattern, brightness, etc.).

This can be achieved in particular in that the modules are configured identically, preferably identically in construction.

With the solution according to the invention, in which two or more projection modules are used for the generation of the light pattern, smaller projection modules can be used, which together deliver the necessary amount of light, can be flexibly arranged, and through the overlaying, according to the invention, of the segment light patterns, an adaptive light pattern with desired resolution can be provided, which depending on the projection modules which are used can also jointly generate various light patterns (dipped headlight, main beam, motorway light, partial main beam).

The greater the number of installed projection modules in a lighting device here, the higher the achievable resolution, the achievable maximum illumination intensity [lx] or respectively the light intensity [cd] and the generated light flux can be.

Advantageous embodiments of the invention are presented more closely below.

In practice, provision can be made e.g. that the nth segment light pattern is displaced in the horizontal direction by a value $VSh(n)=(n-1)/N\times BR$, $n=2, \ldots, N$.

Provision can also be made that the nth segment light pattern is displaced in horizontal direction by a value $VSh(n)=m\times BR+(n-1)/N\times BR$, $n=2, \ldots, N$, $m=0$, 1, or 2, or 3, or greater than 3.

Whereas in the former case the segment light patterns are only slightly displaced, so that a high resolution results over approximately the entire width of the thus generated total light pattern (wherein the resolution naturally further depends additionally on the number N), in the second case each displaced light pattern, compared to the first case, is additionally displaced by an entire main segment width, or by 2 main segment widths, etc. In this way, the total width of the light pattern can be increased.

Furthermore, provision can be made that all the nth segment light patterns, $n=2, \ldots, N$, are displaced in vertical direction in respect of the starting segment light pattern by the same amount and in the same direction, preferably vertically upwards.

Whereas therefore in horizontal direction all the segment light patterns are displaced by different values, in vertical direction all the displaced segment light patterns can be displaced by the same amount.

Provision can be made that in vertical direction at least one of the segment light patterns is arranged in such a way that light segments at least of a line beginning at a straight line lying beneath in the H-H line in the light image extend downwards, and the light segments at least of a line of the light segments from the straight line extend upwards, wherein the straight line lies preferably 0.57° beneath the line H-H.

With the line lying beneath 0.57°, a dipped headlight light pattern can be generated accordingly or a region lying at the light-dark boundary of the dipped headlight light pattern can be illuminated.

The other segment light patterns can be displaced in vertical direction in such a way that a separation line lies between two lines of light segments of the other light patterns above the straight line, wherein preferably the separation line lies beneath the H-H line, preferably 0.23° beneath the H-H line.

In this way e.g. a motorway light light pattern can be generated. For example, for this, all light segments of the segment light patterns under from 0.57° and beneath 0.23° are activated, so that compared to a dipped headlight light pattern, the light-dark threshold is raised to −0.23°. If applicable, (in the case of right-hand traffic) for the right edge of the carriageway also some main beam light segments, i.e. light segments which lie above these threshold lines of −0.57° and −0.23°, can be activated.

For example, the light segments of a segment light pattern are configured to be substantially square or preferably substantially rectangular.

Preferably, provision is made that light segments of a segment light pattern which lie entirely beneath the H-H line, in particular beneath one of the straight lines, have a smaller height, therefore a smaller extent in vertical direction, than light segments lying thereabove.

The vertically "short" light segments lie at the bottom in the light image, whereas the "longer" light segments, especially in the middle of the light pattern (i.e. around the region HV) realize a desired run-out of the main beam light pattern upwards.

In an embodiment, provision is made that all the light segments of a segment light pattern have identical width, namely the main segment width, BR.

In another embodiment, provision is made that the light segments of a line of a segment light pattern have different width, wherein preferably light segments which lie centrally in the region of the line V-V have a first width BR, and light segments which, viewed laterally, lie in horizontal direction, have a second width BR'.

For example, this central region extends horizontally towards the left and right from the line V-V (which lies horizontally at 0°) over a range of −30° to +30°, or over a range of −20° to +20°, or over a range of −15° to +15°.

In particular, provision is made that a width of a light segment which jointly with one or more light segments of a segment light pattern lies centrally adjacent to one another approximately in the region of the line V-V, defines the main segment width, BR.

Usually, the central region of the light pattern around the point HV is more important than the edge regions, so that preferably this region is also used for the determining of the displacement of the segment light patterns.

Preferably, provision is made that the second width for the edge regions is greater than the first width in the central region.

In particular, provision can be made that the light segments of a segment light pattern lie symmetrically in respect of the V-V axis in the light image. The light segments of a segment light pattern of a half of a line are in this case mirrored about the axis V-V.

Preferably, provision is made that the projection modules respectively have an optical axis, and wherein a displacement of a segment light pattern in respect of the starting segment light pattern is produced in that the optical axis of the projection module generating the displaced segment light pattern is inclined both about a horizontal angle and also about a vertical angle against the optical axis of the starting projection module.

Each of the projection modules which generates a displaced segment light pattern is turned accordingly about a corresponding horizontal and vertical angle.

The lighting device according to the invention can be configured as a motor vehicle headlight, or one or more lighting devices according to the invention are arranged in a motor vehicle headlight.

Figure 5:
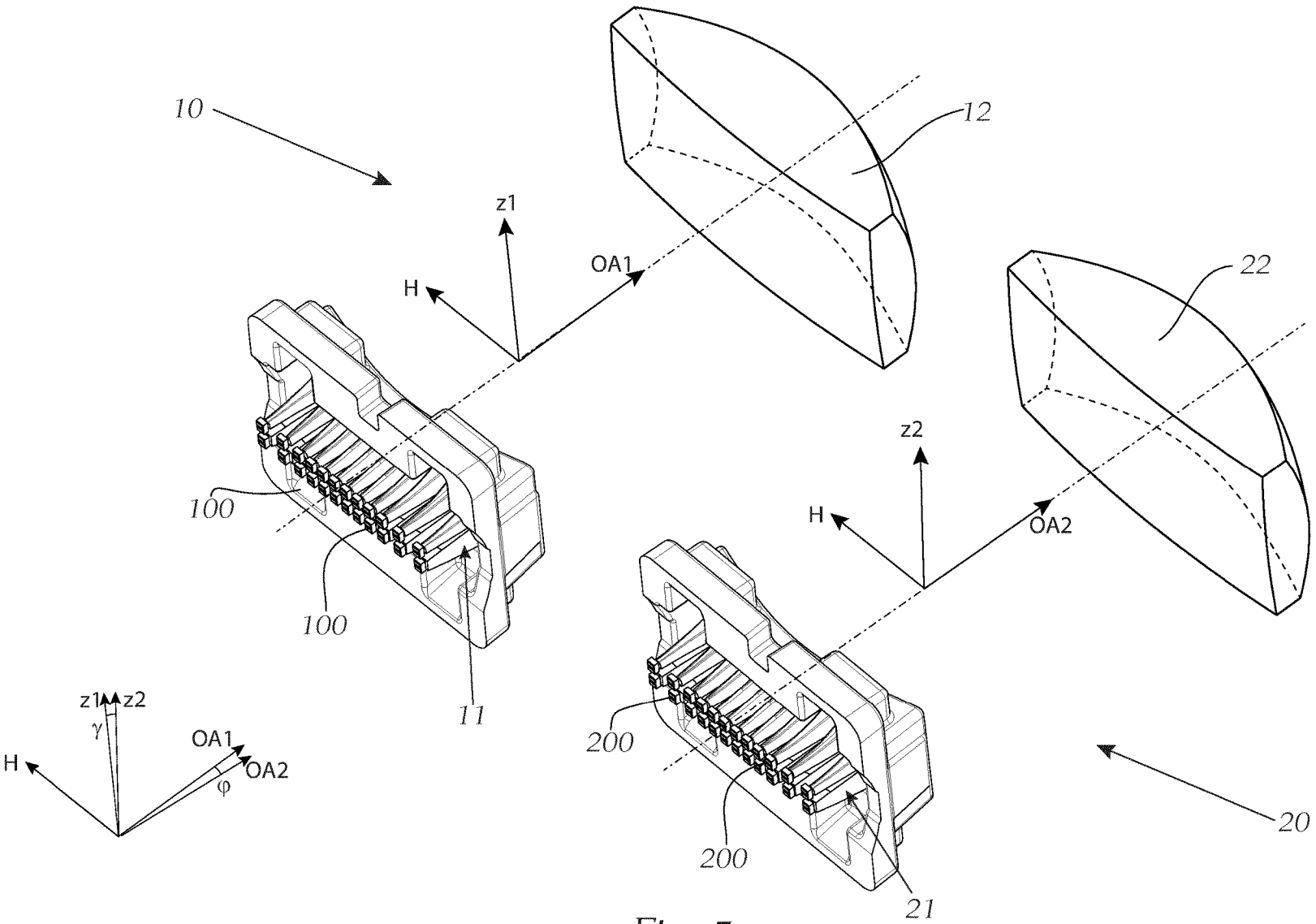
Figure 6:
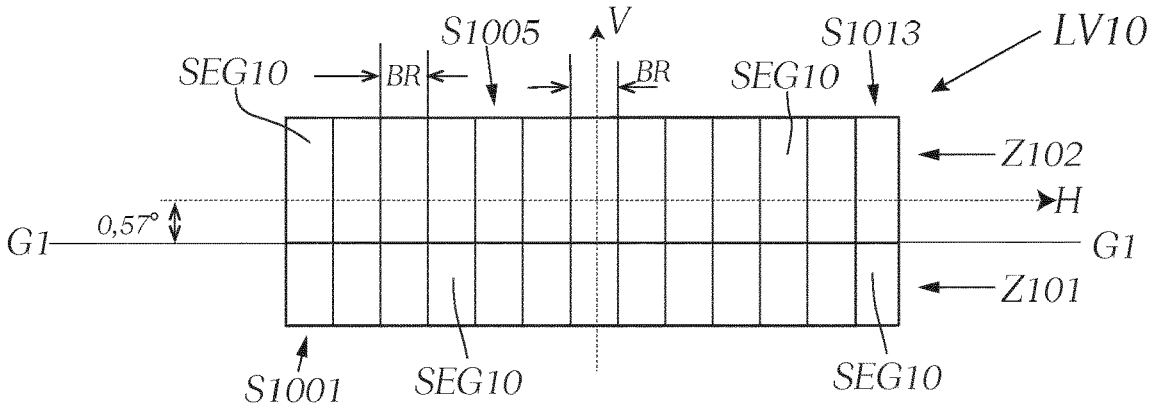
Figure 7:
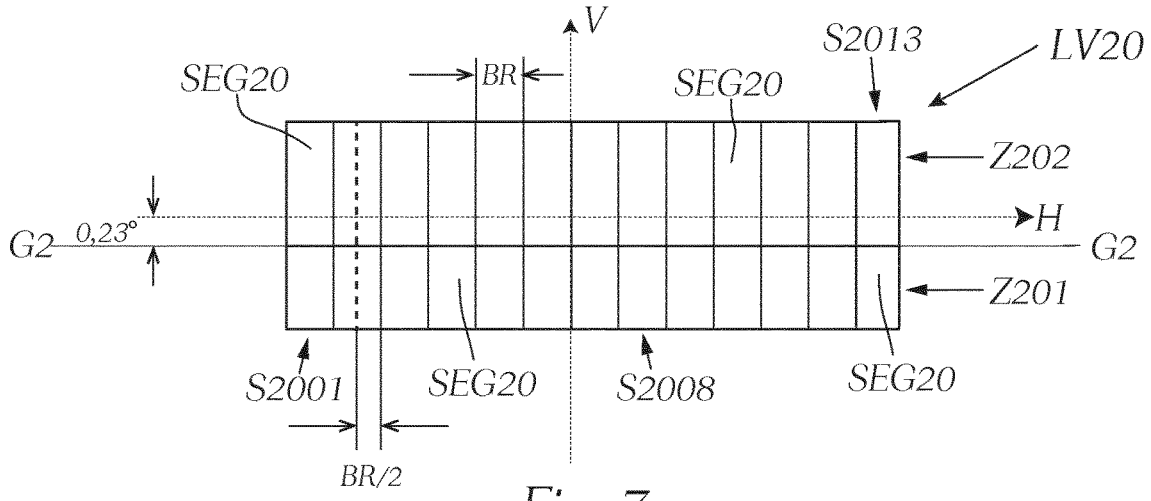

The invention is discussed more closely below with the aid of the drawings. In these there are shown FIG. 1 a perspective view of a lighting device according to the invention with two projection modules, FIG. 2 the lighting device of FIG. 1 with a view onto the schematically illustrated "inner workings" of the projection modules, FIG. 3 a projection module for use in a lighting device of FIG. 1 in a perspective, schematic illustration from behind, FIG. 4 the projection module of FIG. 3 in a perspective view from the front, FIG. 5 the practical arrangement of two projection modules as shown in FIG. 1 in a perspective view from obliquely behind, FIG. 6 schematically, a segmented light pattern ("segment light pattern") generated with a first projection module of FIG. 1 or respectively FIG. 5, FIG. 7 schematically, a segmented light pattern ("segment light pattern") generated with a second projection module of FIG. 1 or respectively FIG. 5, FIG. 8 an overlaying according to the invention of the light patterns of FIG. 6 and FIG. 7, FIG. 9 an overlaying according to the invention of segment light patterns with the use of three projection modules, FIG. 10 a light pattern of FIG. 8 together with a light pattern for the area ahead, and FIG. 11 possible segment light patterns with greater segment widths in the region of the edge.

FIG. 1 shows by way of example a lighting device 1 with two projection modules 10, 20, wherein in this view only the secondary optics in the form of projection lenses 12, 22 are to be seen. Each of the projection modules 10, 20 has an optical axis OA1, OA2, wherein the optical axis OA1, OA2 characterizes respectively e.g. substantially the main light exit direction.

FIG. 2 shows once again the lighting device 1 of FIG. 1, now with—irrelevant for an understanding of the invention—the holder removed for the projection lens 12, 22, so that the view onto the primary optics 11, 21 of the respective projection module 10, 20 is exposed. Each of the primary optics 11, 21 has a light exit surface 11*a*, 12*a*, in which a segmented intermediate light image can be formed, which can be displayed by the associated secondary optics, the focal plane or respectively Petzval surface of which lies in the region of the light exit surface 11*a*, 21*a* of the associated primary optics 11, 21, as a segment light pattern in a region before the lighting device 1, e.g. on a roadway in front of a motor vehicle or on an aiming screen, for instance at a distance of 25 metres.

Figure 2:
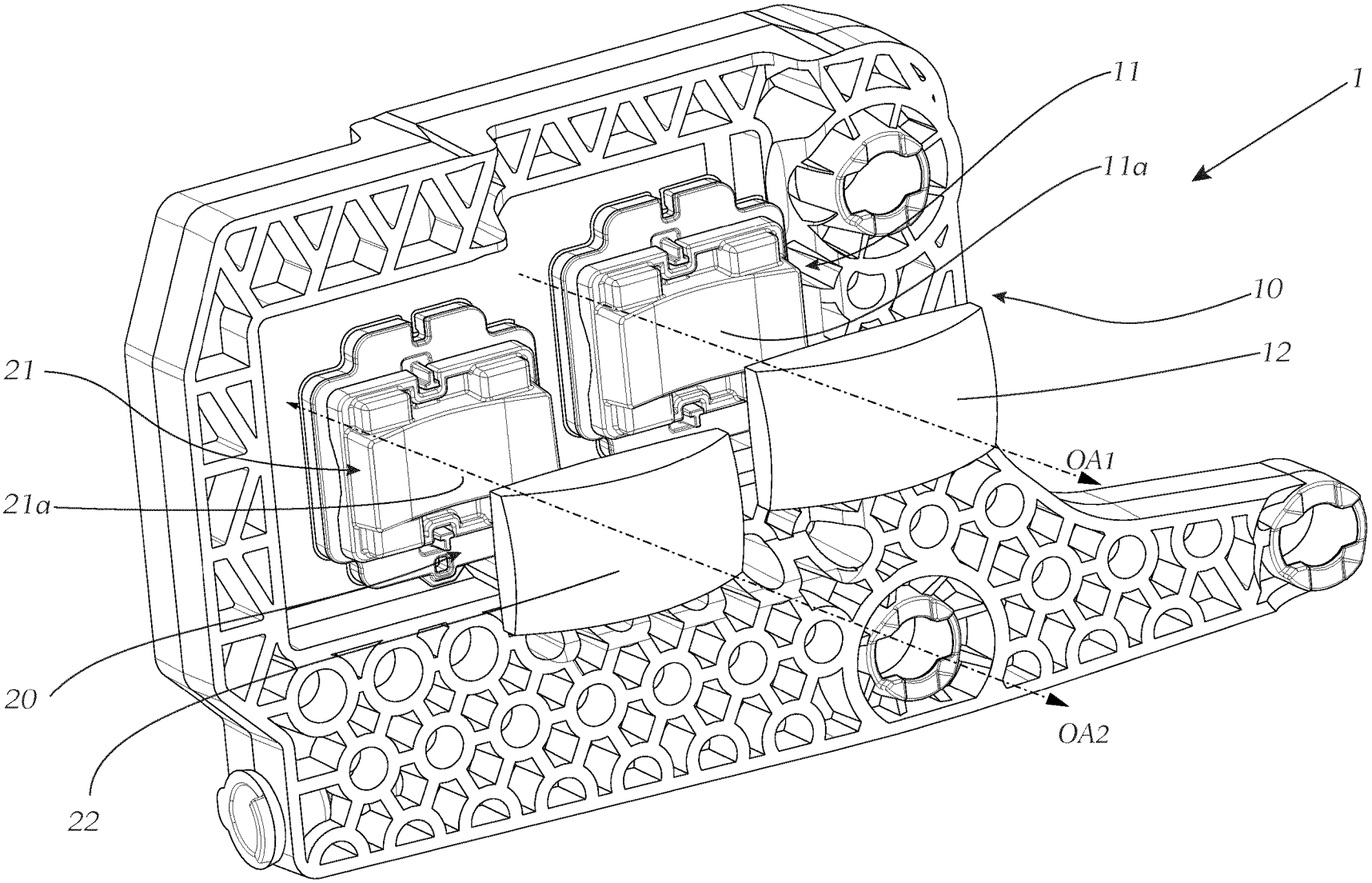
Figure 3:
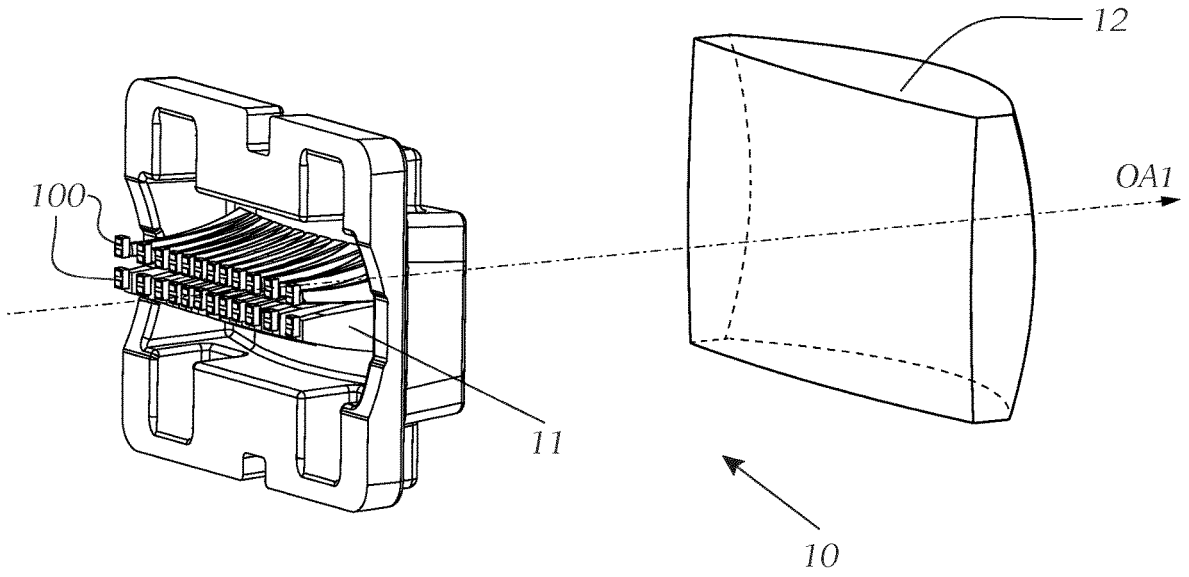
Figure 4:
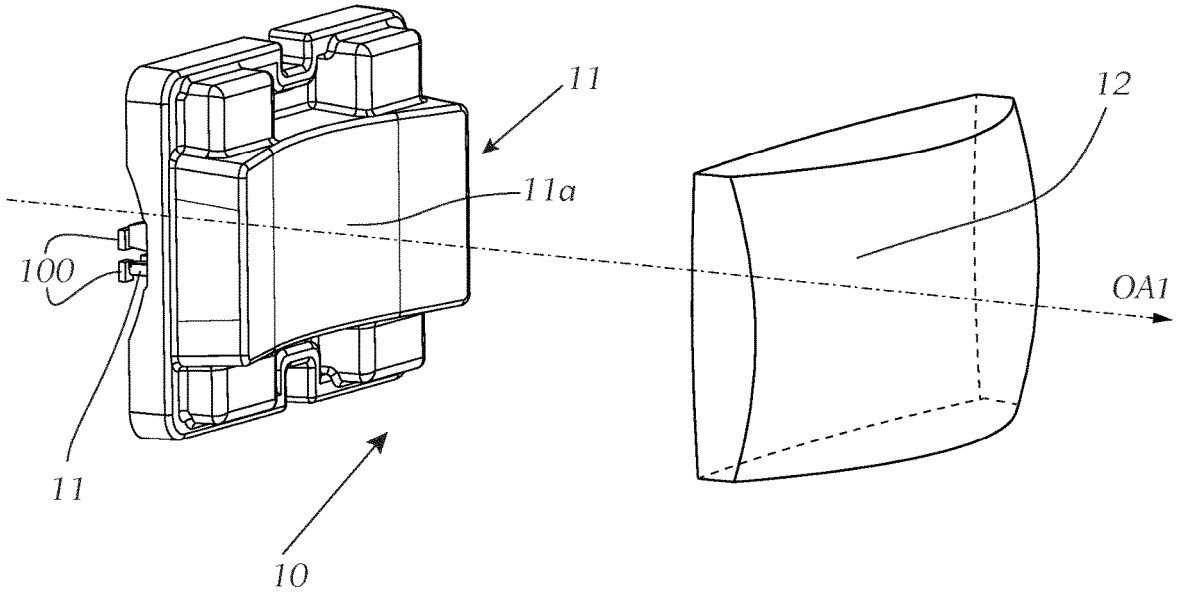

FIGS. 3 and 4 show a projection module 10 of FIGS. 1 and 2 in a detailed view. The primary optics 11 consist here in a known manner of an optical body which has several light guides, wherein a separate light source 100 can couple light into each of the light guides. For example, each light source can comprise an LED or can consist of an LED. The light guides consist e.g. of an optically transparent, light-conducting material, in which the light of the light sources can be propagated and e.g. is totally reflected as the boundary walls. The light guides converge into the common light exit surface 11*a* and generate a segment light pattern, as was already discussed in the introduction to the description.

The projection module 10 shown in FIGS. 3 and 4 is a preferably used module, basically every projection module which can generate a segment light pattern as described in the introduction, is able to be used.

FIG. 5 shows two projection modules 10, 20 of identical construction, as described by means of FIGS. 3 and 4. With an imaginary identical arrangement, i.e. identical alignment and positioning at the same location, these projection modules 10, 20 would generate identical, congruent segment light patterns. The light sources of the second projection module 20 are designated by "200".

According to the invention, the optical axis OA2 of the second projection module 20 is inclined both about a horizontal angle φ and about a vertical angle γ against the optical axis OA1 of the first, so-called starting projection module 10, whereby the segment light pattern of the second projection module 20 is displaced with respect to that of the first projection module 10, as described more closely further below. The arrangement of the projection modules 10, 20 adjacent to one another is purely by way of example. In a distance of e.g. 25 metres on an aiming screen, i.e. in the far field, the practical position of the individual projection modules, therefore a local offset of the modules with respect to one another is negligible, the alignment of the optical axis OA1, OA2 is crucial.

FIG. 6 shows a segment light pattern LV10 ("starting segment light pattern"), generated with the first or respectively starting projection module 10. The lines H-H (or respectively axis H) and V-V (or respectively axis V) characterize in a known manner the horizontal 0°-0° and the vertical 0°-0° line for the presentation of light patterns.

The segment light pattern LV10 consists of several rectangular light segments SEG10, which in this example are arranged in two lines Z101, Z102 and thirteen columns S1001 . . . S1013. These numbers are selected purely by way of example to explain the invention, more or fewer columns and lines can also be used, wherein, however, preferably at least 2 lines and at least 2 columns are provided.

All light segments have the same width (extent in horizontal direction) BR, the so-called main segment width BR, for example the width can be 2.4°, preferably also 1.2°.

Furthermore, a straight line G1 can be seen, which separates the two lines Z101, Z102 from one another. The straight lint G1 preferably leads 0.57° beneath the line H-H.

FIG. 7 shows a segment light pattern LV20, generated with the second projection module 20. The segment light pattern LV20 would be optically identical to the segment light pattern LV10, is however, in the light pattern already according to the invention displaced both in horizontal and also in vertical direction, and consists of several rectangular light segments SEG20, the two lines Z201, Z202 and thirteen columns S2001 . . . S2013 are arranged. All light segments SEG20 have the same width (extent in horizontal direction) BR, the so-called main segment width BR.

Figure 8:
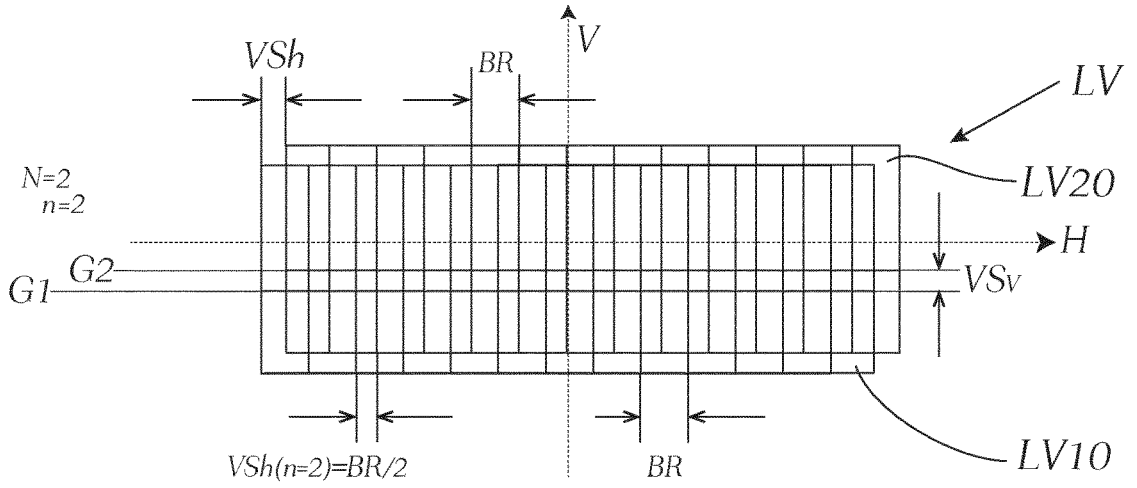

FIG. 8 shows a light pattern LV as an overlaying, according to the invention, of the segment light patterns LV10, LV20, preferably by a turning of the projection modules 10, 20 as shown in FIG. 5.

The general correlation for the value of the displacement of the nth segment light pattern results at $VSh(n)=m\times BR+(n-1)/N\times BR$, n=2, . . . , N, m=0, 1, or 2, or 3, or greater than 3, is displaced in horizontal direction. The second segment light pattern (which represents the first displaced segment light pattern) carries the number n=2, the starting segment light pattern is the first light pattern.

In the example according to FIG. 8, the following applies:

N=2, (therefore n=2)

m=0

In horizontal direction, according to the invention, the second segment light pattern LV20 is displaced towards the right by a value VSh, which corresponds to half the main segment width BR, with respect to the starting segment light pattern LV10: VSh(n=2)=BR/2. In vertical direction, the second segment light pattern LV20 is likewise displaced, and namely by value VSv upwards. The vertical displacement VSv is preferably selected here in such a way that a second straight line G2, which separates the two lines Z201, Z202 from one another, is 0.23° beneath the line H-H.

At this point, it is to be noted that the straight lines G1 and G2 differ from one another only with segment light patterns which are displaced with respect to one another. With identical alignment of the projection modules 10, 20, the straight lines G1, G2 would coincide.

Figure 9:
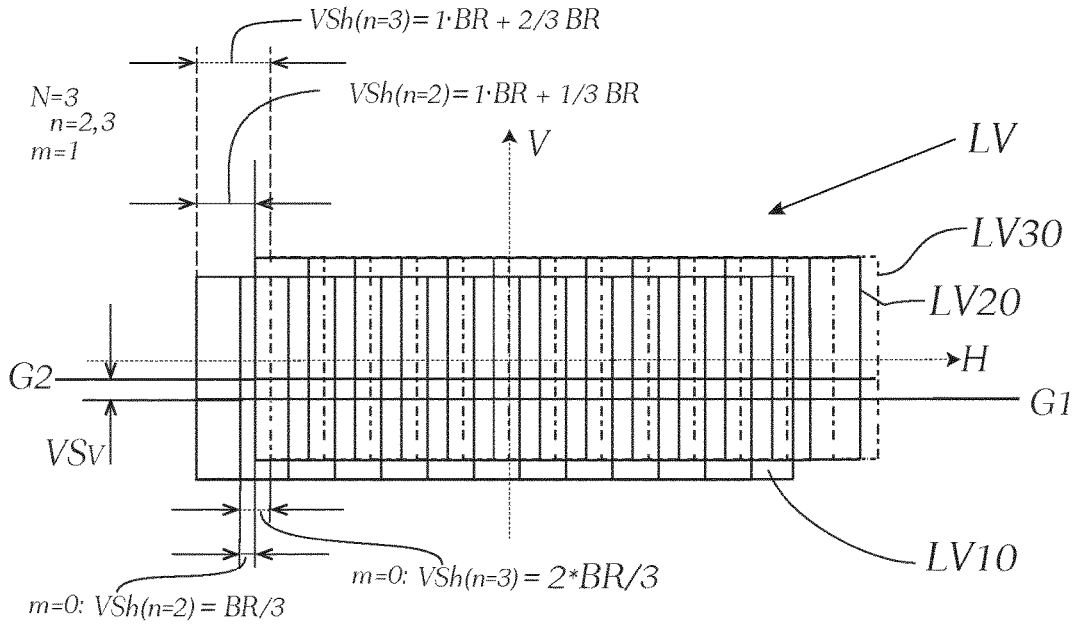
Figure 10:
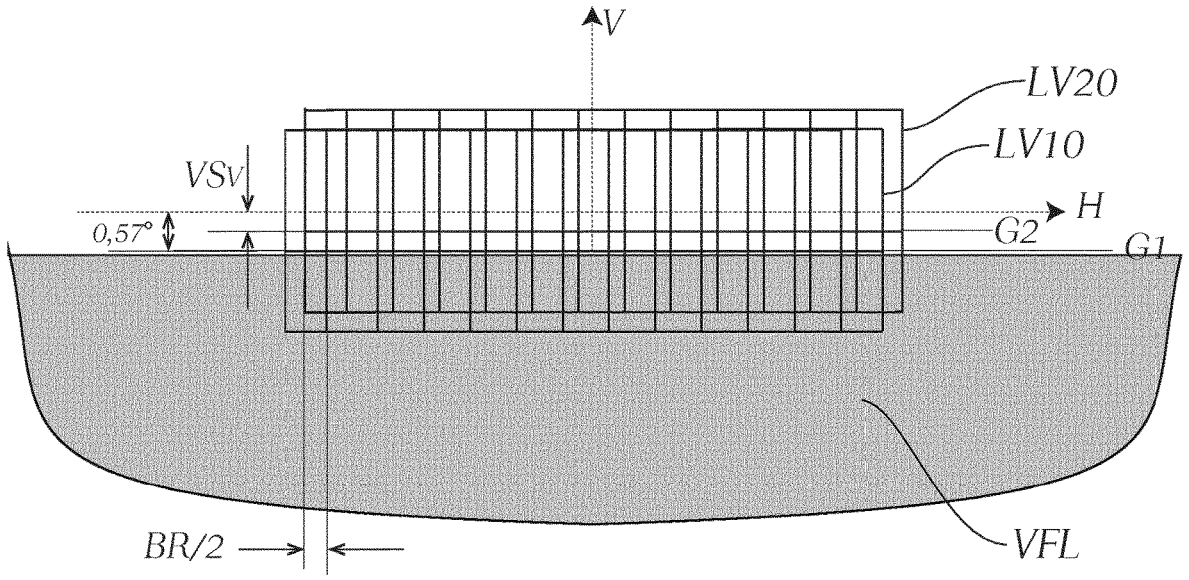

FIG. 9 shows a further example of a light pattern LV, now as overlaying of the segment light patterns of 3 projection modules (N=3), which form three (identical per se) segment light patterns LV10, LV20, LV30. These segment light patterns LV10, LV20, LV30 correspond to that of FIG. 6 or respectively 7.

In the example according to FIG. 9, the following applies:

N=3, (therefore n=2, 3)

m=1

Proceeding from the starting segment light pattern LV10, accordingly the second (n=2) segment light pattern LV20 (=the first displaced segment light pattern) is displaced by 1*BR/3 horizontally towards the right, the third (n=3) segment light pattern LV30 (=the second displaced segment light pattern) is displaced by 2*BR/3 horizontally towards the right.

Optionally, as shown, provision can further be made that in addition each of the two displaced segment light patterns LV20, LV30 is displaced by a fixed amount of e.g. a main segment width BR, corresponding to the value m=1, so that the segment light patterns LV20, LV30 in this example in total are displaced by VSh (n=2)=BR+BR/3 and VSh (n=3)=BR+2*BR/3 horizontally towards the right.

With respect to the displacement VSv in vertical direction, reference is to be made to the statements concerning FIG. 8. The two displaced segment light patterns LV20, LV30 are displaced in vertical direction in the same value VSv; this corresponds to the value as described in FIG. 8.

As can be readily seen in the overlayings of FIG. 8 and FIG. 9, depending on the number of the projection modules which are used (and the type of projection modules which are used), the light intensity can be controlled in a targeted manner, and a high resolution, in particular in horizontal direction, results, which increases with the number of projection modules which are used, so that through targeted activating and deactivating of particular light segments of the individual segment light patterns, desired light patterns, such as dipped headlight, motorway light and main beam and various fade-out scenarios can be realized.

FIG. 10 shows once again the light pattern LV of FIG. 8, together with a light pattern for the area ahead VFL, which is generated by a further lighting device which is not shown; this light pattern for the area ahead VFL is preferably always activated, in particular not segmented, and preferably forms a homogeneous illumination in the "near range" (for example up to 45 m) in front of the motor vehicle.

The light pattern for the area ahead VFL preferably adjoins the (adaptive) light pattern LV approximately beneath the straight line G1.

Figure 11:
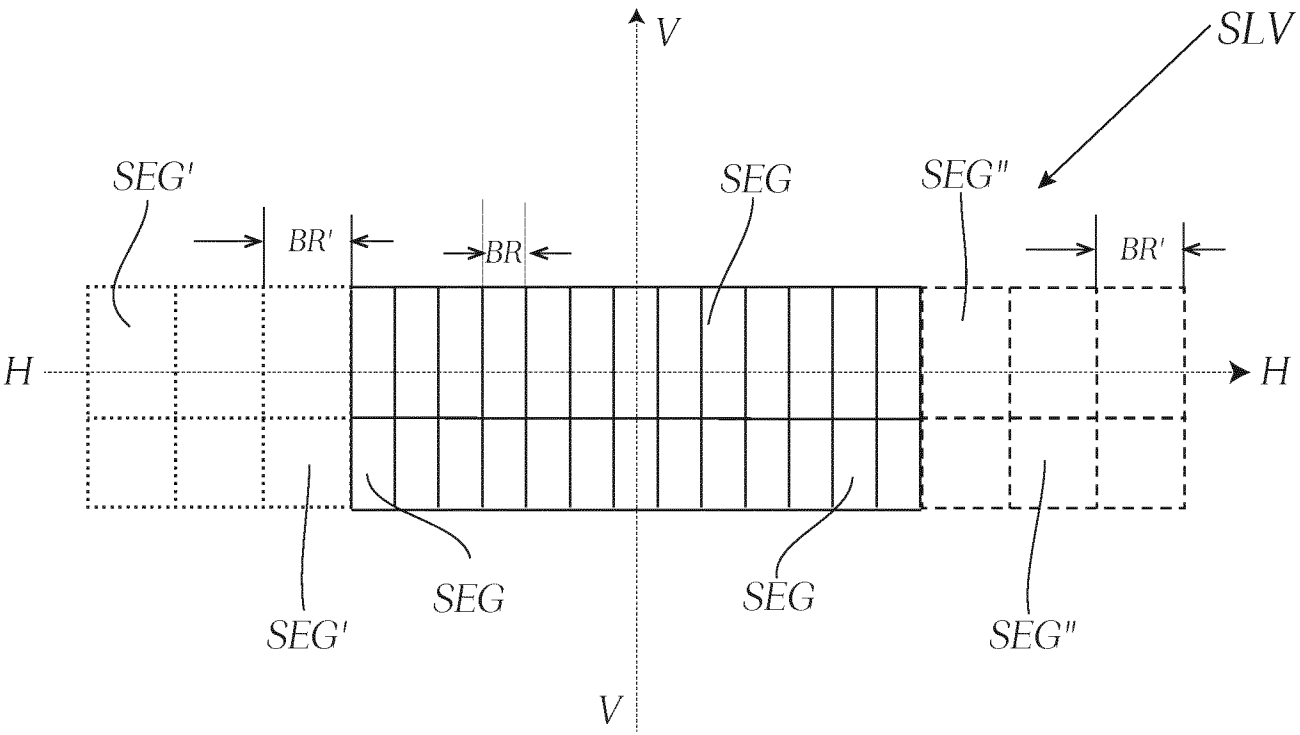

FIG. 11, finally, shows in addition two special cases of the present invention.

In the above figures, all the light segments have identical width BR. However, provision can also be made that adjoining a central region about the line V-V, in which the light segments SEG all have a first, identical width BR, adjoining to left and right further light segments SEG', SEG" are provided, which have a second width BR'. Typically, the second width BR' is greater than the first width.

The first width BR defines the main segment width, and two or more identical such segment light patterns SLV as shown in FIG. 11 can then be overlaid in an analogous manner as above with the aid of FIGS. 6 to 9 to an, in particular adaptive, light pattern.

The left-hand region with the light segments SEG' is illustrated in dotted lines, the right-hand region with the light segments SEG" is illustrated in dashed lines. Thereby, it is to be indicated that, deviating from the above paragraphs, a first segment light pattern SLV has wider light segments SEG' e.g. only on the left-hand side, alongside the central region of the light segments SEG. A further segment light pattern SLV, to be displaced according to the invention, has, alongside the central region, wider segments SEG" only on the right-hand side.

In this case, the term "optically identical" is to be understood to mean that two modules, in particular projection modules, which are "optically identical", with arrangement at identical position and with identical alignment, form identical light patterns only in the central region (as is discussed by way of example in the introduction to the description), wherein in particular also the individual light segments in the central region of the projection modules are configured in an identical manner, lie at an identical location in the light image and have the same light values (light pattern, brightness, etc.). To the left and right of the central region, "optically identical" modules can, on the other hand, generate different light segment patterns, e.g. as described above, a first and, if applicable, third, fifth, etc. module can have wider light segments only on the left of the central region, and the second and, if applicable, fourth, sixth etc. module can have wider light segments only on the right-hand side. Preferably here, a light pattern on the left of the central region (e.g. of the first segment light pattern) is mirrored about the V-V axis, in order to form the light pattern on the right of the central region (e.g. of the second segment light pattern).

Such "optically identical" light patterns can be generated either with identical projection modules, in particular identical in construction, wherein each light module certain light sources, which would generate light segments which are not used, are not operated, or the projection nodules are respectively adapted accordingly, so that for the odd-numbered segment light patterns a first type of projection modules of identical construction and for the even-numbered segment light patterns a second type of projection modules of identical construction is used.

The invention claimed is:

1. A lighting device (1) for a motor vehicle headlight for generating a light pattern (LV) or a part of a light pattern, the lighting device comprising:

a number N of projection modules (10, 20), where N=2, 3, 4 or greater than 4, each of the projection modules (10, 20) being configured to generate a segment light pattern (LV10, LV20), wherein the segment light pattern (LV10, LV20) is formed from several light segments (SEG10, SEG20), and wherein the light segments (SEG10, SEG20) of the segment light pattern (LV10, LV20) lie in two or more substantially horizontal lines (Z101, Z102, Z201, Z202) and in two or more columns (S1001, . . . , S1005, . . . S1013, S2001, . . . , S2005, . . . S2013), wherein the light segments (SEG10, SEG20) lie in such a way that on activation of all light segments (SEG10, SEG20) of the segment light pattern (LV10, LV20) substantially no dark or light strips are formed between the lines and the columns, wherein each light segment (SEG10, SEG20) of the segment light pattern (LV10, LV20; LV10, LV20, LV30) can be activated or deactivated independently of the other segments of the segment light pattern (LV10, LV20; LV10, LV20, LV30), wherein in each line (Z101, Z102, Z201, Z202) several segments (SEG10, SEG20), the so-called main segments, have identical main segment width, BR, wherein all projection modules (10, 20) are configured identically from an optical point of view, wherein the projection modules (10, 20) are arranged with respect to one another in such a way that, proceeding from a first projection module (10) the so-called starting projection module (10), which generates a so-called starting segment light pattern (LV10), the segment light patterns (LV20; LV20, LV30) of the further projection modules (20) are displaced laterally in a common horizontal direction, wherein the extent of the displacement, VSh, of the nth segment light pattern (LV20; LV20, LV30) of the nth projection module (20) in this horizontal direction corresponds to a value $VSh(n)=m\times BR+(n-1)/N\times BR$, n=2, . . . , N, m=0, 1, or 2, or 3, or greater than 3, wherein at least one of the nth segment light patterns (LV20; LV10, LV20, LV30), n=2, . . . , N, is displaced upwards or downwards in vertical direction in respect of the starting segment light pattern (LV10), wherein the projection modules are identically constructed, and wherein the projection modules (10, 20) have respectively an optical axis (OA1, OA2), and wherein a displacement of a segment light pattern (LV20) in respect of the starting segment light pattern (LV10) thereby results, that the optical axis (OA2) of the projection module (20) generating the displaced segment light pattern (LV20) is inclined both about a horizontal angle (φ) and also about a vertical angle (γ) against the optical axis (OA1) of the starting projection module (10).

2. The lighting device according to claim 1, wherein the nth segment light pattern (LV20; LV20, LV30) is displaced in the horizontal direction by a value $VSh(n)=(n-1)/N\times BR$, n=2, . . . , N.

3. The lighting device according to claim 1, wherein all of the nth segment light patterns (LV20; LV20, LV30), n=3, . . . , N, are displaced in vertical direction in respect to the starting segment light pattern (LV10) by the same amount and in the same direction.

4. The lighting device according to claim 3, wherein the same direction is vertically upwards.

5. The lighting device according to claim 1, wherein, in a vertical direction, at least one of the segment light patterns (LV10) is configured such that light segments (SEG10) at least of a line (Z102) beginning at a straight line (G1) lying beneath the H-H line in the light image extend downwards, and the light segments (SEG10) at least of a line (Z101) of the light segments extend upwards from the straight line (G1).

6. The lighting device according to claim 5, wherein the other segment light patterns (LV20; LV20, LV30) are displaced in vertical direction (V) in such a way that a separation line (G2) lies between two lines (Z201, Z202) of light segments (SEG20) of the other light patterns above the straight line (G), wherein the separation line (G2) lies beneath the H-H line.

7. The lighting device according to claim 6, wherein the separation line (G2) lies 0.23° beneath the H-H line.

8. The lighting device according to claim 5, wherein the straight line (G1) lies 0.57° beneath the line H-H.

9. The lighting device according to claim 1, wherein light segments (SEG10, SEG20) of a segment light pattern (LV10, LV20), which lie entirely beneath the H-H line, in particular beneath one of the straight lines (G1, G2), have a smaller height, therefore a smaller extent in vertical direction (V) than light segments (SEG10, SEG20) lying thereabove.

10. The lighting device according to claim 9, wherein the light segments of a segment light pattern in respect of the V-V axis lie symmetrically in the light image.

11. The lighting device according to claim 1, wherein all light segments (SEG10, SEG20) of a segment light pattern have identical width, namely the main segment width, BR.

12. The lighting device according to claim 1, wherein the light segments of a line of a segment light pattern have different width, wherein light segments which lie centrally in the region of the line V-V have a first main segment width, BR, and light segments which lie in horizontal direction viewed laterally, have a second main segment width BR'.

13. The lighting device according to claim 12, wherein a width (BR) of a light segment, which together with one or more light segments of a segment light pattern lies centrally adjacent to one another approximately in the region of the line V-V, defines the main segment width, BR.

14. The lighting device according to claim 12, wherein the second width (BR') is greater than the first width (BR).

15. The lighting device according to claim 1, wherein the lighting device is configured as a motor vehicle headlight.

16. A motor vehicle headlight with at least one lighting device according to claim 1.

17. The lighting device according to claim 1, wherein the light pattern (LV) is an adaptive light pattern or a main beam light pattern.

18. The lighting device according to claim 17, wherein the adaptive light pattern is an adaptive dipped headlight.

* * * * *